US009930749B2

(12) United States Patent
Yang

(10) Patent No.: US 9,930,749 B2
(45) Date of Patent: Mar. 27, 2018

(54) LIGHTING STRUCTURE WITH PATTERNS

(71) Applicant: ASUSTeK COMPUTER INC., Taipei (TW)

(72) Inventor: Fei-Lin Yang, Taipei (TW)

(73) Assignee: ASUSTEK COMPUTER INC., Taipei (TW)

( * ) Notice: Subject to any disclaimer, the term of this patent is extended or adjusted under 35 U.S.C. 154(b) by 0 days.

(21) Appl. No.: 15/458,151

(22) Filed: Mar. 14, 2017

(65) Prior Publication Data

US 2017/0290125 A1 Oct. 5, 2017

(30) Foreign Application Priority Data

Mar. 29, 2016 (TW) ..... 105109928 A

(51) Int. Cl.
*H05B 33/12* (2006.01)
*H05B 33/04* (2006.01)
*G09F 13/22* (2006.01)

(52) U.S. Cl.
CPC ..... *H05B 33/12* (2013.01); *G09F 13/22* (2013.01); *H05B 33/04* (2013.01)

(58) Field of Classification Search
CPC ..... H05B 33/12; H05B 33/04; H05B 33/14; H05B 33/145; H05B 33/18; H05B 33/20; H05B 33/22; H05B 33/24; H05B 33/26; H05B 33/28; G09F 13/22
See application file for complete search history.

(56) References Cited

U.S. PATENT DOCUMENTS

| | | | | |
|---|---|---|---|---|
| 4,734,617 | A * | 3/1988 | Jacobs | H05B 33/12 313/506 |
| 9,158,040 | B2 | 10/2015 | Kamiyama et al. | |
| 9,801,254 | B2 * | 10/2017 | Hsing | H05B 33/10 |
| 2010/0060142 | A1 | 3/2010 | Itou et al. | |
| 2015/0085369 | A1 | 3/2015 | Tazawa et al. | |
| 2015/0273792 | A1 | 10/2015 | Tazawa | |
| 2016/0183346 | A1 * | 6/2016 | Hsing | H05B 33/145 362/293 |

FOREIGN PATENT DOCUMENTS

| | | |
|---|---|---|
| CN | 104516032 A | 4/2015 |
| CN | 104950357 A | 9/2015 |
| TW | 200904236 A | 1/2009 |

* cited by examiner

*Primary Examiner* — Anne Hines
(74) *Attorney, Agent, or Firm* — McClure, Qualey & Rodack, LLP

(57) ABSTRACT

A lighting structure with patterns includes an electro-luminescence (EL) layer, a glass layer, a first ultraviolet (UV) ink layer, a non-conductive vacuum metallization (NCVM) layer and an optically clear adhesive (OCA) layer. The first UV ink layer includes a first surface and a second surface. The first surface is laminated to the glass layer. The second surface includes a first pattern. The NCVM layer is formed on the second surface of the first UV ink layer. The OCA layer is coated on the EL layer. The EL layer is laminated to the NCVM layer via the OCA layer.

10 Claims, 2 Drawing Sheets

LIGHTING STRUCTURE WITH PATTERNS

CROSS-REFERENCE TO RELATED APPLICATION

This application claims the priority benefit of TW application serial No. 105109928, filed on Mar. 29, 2016. The entirety of the above-mentioned patent applications are hereby incorporated by reference herein and made a part of specification.

BACKGROUND OF THE INVENTION

Field of the Invention

The disclosure relates to a lighting structure and, more particularly, to a lighting structure with an electro-luminescence layer.

Description of the Related Art

A device with a luminescent panel or a transparent panel for showing a commodity name or a trademark, or using as an electronic advertising board, a pattern is formed on a transparent PET layer of the device or the electronic advertising board by imprinting or etching. When light emits from a light-emitting unit that connected to the PET layer, the pattern is showed due to light refraction.

BRIEF SUMMARY OF THE INVENTION

According to an aspect, a lighting structure is provided. A lighting structure with patterns comprises: an electro-luminescence (EL) layer; a glass layer; a first ultraviolet (UV) ink layer, wherein the first UV ink layer includes a first surface and a second surface, the first surface is laminated to the glass layer, the second surface includes a first pattern; a non-conductive vacuum metallization (NCVM) layer, wherein the NCVM layer is formed on the second surface of the UV ink layer; and an optically clear adhesive (OCA) layer, wherein the OCA layer is coated on the EL layer, and the EL layer is laminated to the NCVM layer via the OCA layer.

According to another aspect, a lighting structure is provided. A lighting structure with patterns, comprises: an electro-luminescence (EL) layer; a glass layer, wherein a pattern is formed on a surface of the glass layer; a non-conductive vacuum metallization (NCVM) layer, wherein the NCVM layer is formed on the surface of the glass layer with the pattern; and an optically clear adhesive (OCA) layer, wherein the OCA layer is coated on the EL layer, and the EL layer is laminated to the NCVM layer via the OCA layer.

BRIEF DESCRIPTION OF THE DRAWINGS

These and other features, aspects and advantages of the disclosure will become better understood with regard to the following embodiments and accompanying drawings.

DETAILED DESCRIPTION OF THE EMBODIMENTS

Figure 1:
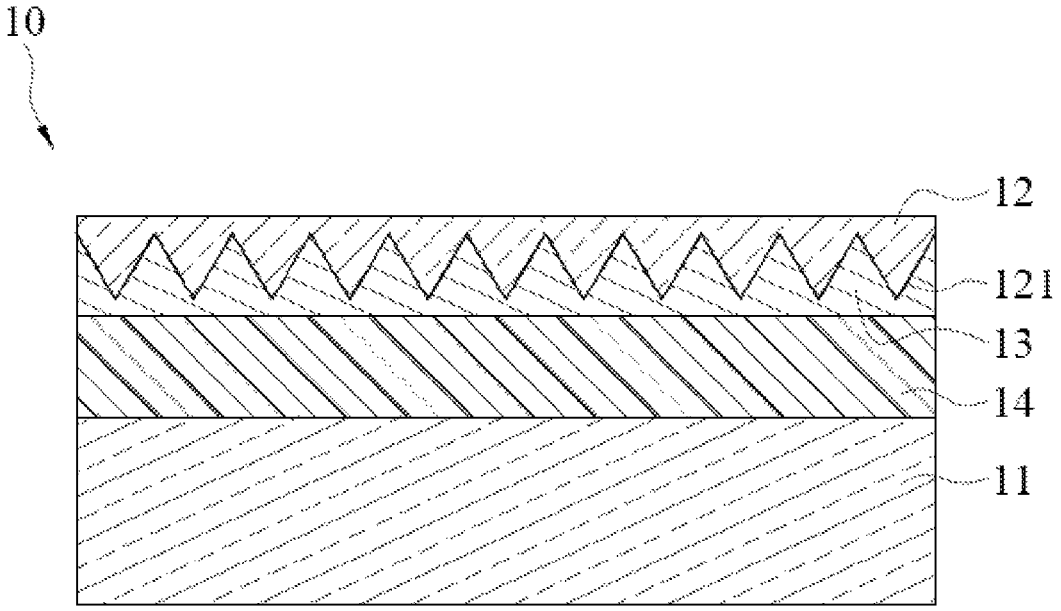
FIG. 1 is a schematic diagram showing a lighting structure with patterns in an embodiment.

A proportion and a thickness of each of layers in figures are just examples, but not used to limit the disclosure. Please refer to FIG. 1, which is a schematic diagram showing a lighting structure with patterns in an embodiment. In the embodiment, a lighting structure 10 includes an electro-luminescence (EL) layer 11, a glass layer 12, a non-conductive vacuum metallization (NCVM) layer 13 and an optically clear adhesive (OCA) layer 14. In the embodiment, the thickness of the EL layer 11 is about 50 μm to 100 μm.

In an embodiment, a pattern 121 is formed on a surface of the glass layer 12 by a method of producing the pattern. In an embodiment, the method of producing the pattern includes a photolithography step, an exposure step, a development step and an etching step. In the embodiment, the thickness of the glass layer 12 is about 3 μm to 13 μm. The NCVM layer 13 is evaporated or sputtered on the surface of the glass layer 12 with the pattern 121 via a vacuum system. In the embodiment, the thickness of the NCVM layer 13 is about 0.1 μm to 0.5 μm.

In an embodiment, the OCA layer 14 is coated on the EL layer 11. The EL layer 11 is laminated to the NCVM layer 13 through the OCA layer 14 by a laminating device. In the embodiment, a refractive index of the NCVM layer 13 is about 1, a refractive index of the glass layer 12 is about 2, and a refractive index of the OCA layer 14 is about 1.4. Consequently, the refractive index of the NCVM layer 13 is less than the refractive index of the glass layer 12 and the refractive index of the OCA layer 14.

As shown in FIG. 1, the layer from top to bottom is the glass layer 12, the NCVM layer 13, the OCA layer 14 and the EL layer 11. When the EL layer 11 is connected to a power source, the light passes through the OCA layer 14, the NCVM layer 13 and the glass layer 12 and emits out of the top surface of the glass layer 12. When the user views FIG. 1 from the top, the pattern 121 formed on the glass layer 12 can be viewed due to the light refraction. In the embodiment, since the refractive index of the NCVM layer 13 is different with the refractive index of the glass layer 12, even that the NCVM layer 13 fills gaps of the pattern 121 on the glass layer 12, the pattern 121 still can be viewed.

Figure 2:
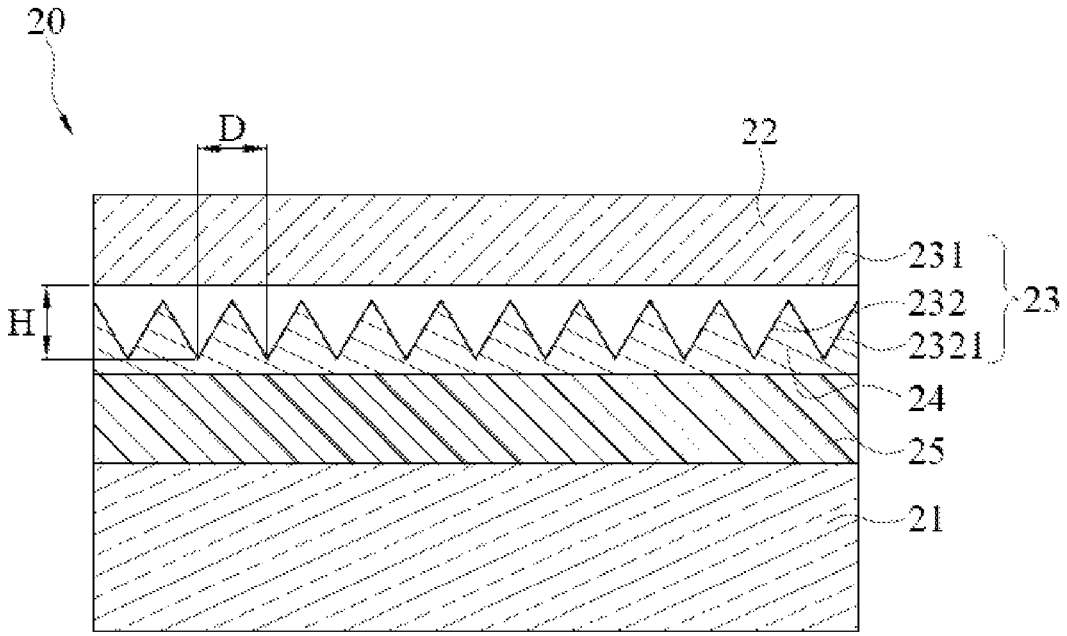
FIG. 2 is a schematic diagram showing a lighting structure with patterns in an embodiment.

Please refer to FIG. 2. FIG. 2 is a schematic diagram showing a lighting structure with patterns in an embodiment. In the embodiment, the lighting structure 20 includes an EL layer 21, a glass layer 22, an ultraviolet (UV) ink layer 23, a NCVM layer 24 and an OCA layer 25. In the embodiment, the thickness of the EL layer 21 is 50 μm to 100 μm.

In an embodiment, the UV ink layer 23 is imprinted to the glass layer 22. The UV ink layer 23 includes a first surface 231 and a second surface 232 opposite to each other. The first surface 231 is adhered to the glass layer 22. The pattern 2321 is formed on the second surface 232. After the UV ink layer 23 is imprinted to the glass layer 22 and the pattern 2321 is formed, a photo-cured step is executed to form a pattern effect. In the embodiment, the thickness of the UV ink layer 23 is about 3 μm to 10 μm. The breadth D of the pattern 2321 formed on the UV ink layer 23 is about 1 μm to 10 μm, and the height H of the pattern 2321 is about 3 μm to 10 μm.

The NCVM layer 24 is evaporated or sputtered on the second surface 232 of the UV ink layer 23 with the pattern 2321 via the vacuum system. In the embodiment, the thickness of the NCVM layer 24 is about 0.1 μm to 0.5 μm.

In the embodiment, the OCA layer 25 is coated on the EL layer 21. The EL layer 21 is laminated to the NCVM layer 24 via the OCA layer 25 by the laminating device. In the embodiment, the refractive index of the NCVM layer 24 is about 1. The refractive index of the glass layer 22 is about 2. The refractive index of the UV ink layer 23 is equal to more than 1.7. The refractive index of the OCA layer 14 is equal to more than 1.4. Consequently, the refractive index of the UV ink layer 23 is greater than that of the NCVM layer 24 and less than that of the glass layer 22.

In the embodiment, the UV ink layer 23 comprises sulfur-containing epoxy monomer and acrylic monomer. The ratio of the sulfur-containing epoxy monomer and the acrylic monomer in the UV ink layer 23 is about 1:1. The refractive index of the formed UV ink layer 23 is about 1.7. In an embodiment, the polyoxyethylene is added to the material of the UV ink layer 23 to increase the refractive index, and the ratio of the above three materials is about 1:1:1.

As shown in FIG. 2, the layers of the lighting structure 20 is the glass layer 22, the UV ink layer 23, the NCVM layer 24, the OCA layer 25 and the EL layer 21 from top to bottom in sequence. When the EL layer 21 is connected to the power source, the light emits out from the top surface of the glass layer 22 after passing through the OCA layer 25, the NCVM layer 24, the UV ink layer 23, and the glass layer 22. When the user views from the top, the pattern 2321 formed on the UV ink layer 23 can be viewed due to the light refraction. In the embodiment, since the refractive index of the UV ink layer 23 is different from the refractive index of the NCVM layer 24, the pattern 2321 on UV ink layer 23 still can be viewed even the NCVM layer 24 fills gaps of the pattern 2321 on the UV ink layer 23.

Figure 3:
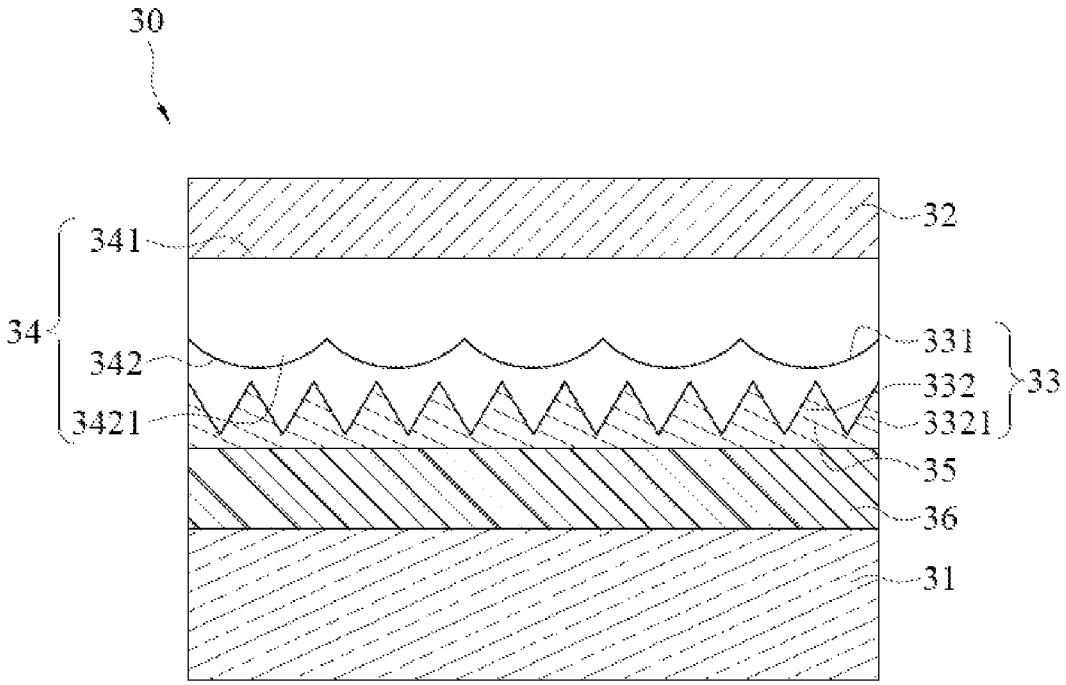
FIG. 3 is a schematic diagram showing a lighting structure with patterns in an embodiment.

Please refer to FIG. 3. FIG. 3 is a schematic diagram showing a lighting structure with patterns in an embodiment. In the embodiment, the lighting structure 30 includes an EL layer 31, a glass layer 32, a first UV ink layer 33, a second UV ink layer 34, a NCVM layer 35 and an OCA layer 36. In the embodiment, the thickness of the EL layer 31 is about 50 μm to 100 μm.

In an embodiment, a second UV ink layer 34 is imprinted to the glass layer 32. The second UV ink layer 34 includes a first surface 341 and a second surface 342 opposite to each other. The first surface 341 of the second UV ink layer 34 is laminated to the glass layer 32. The second the pattern 3421 is formed on the second surface 342 of the second UV ink layer 34. The first UV ink layer 33 is imprinted to the second UV ink layer 34. The first UV ink layer 33 includes a first surface 331 and a second surface 332 opposite to each other. The first surface 331 of the first UV ink layer 33 is laminated to the second surface 342 of the second UV ink layer 34. The first pattern 3321 is formed on the second surface 332 of the first UV ink layer 33. A photo-cured step is executed to form a pattern effect.

In the embodiment, the thickness of the first UV ink layer 33 is about 3 μm to 10 μm, and the thickness of the second UV ink layer 34 is about 1 μm to 3 μm. The first pattern 3321 formed on the first UV ink layer 33 and the second the pattern 3421 formed on the second UV ink layer 34 are the same or different. In an embodiment, the first pattern 3321 and the second the pattern 3421 are intersected, completely separated with each other or completely overlapped, which is not limited herein.

The NCVM layer 35 is evaporated or sputtered on the second surface 332 of the first UV ink layer 33 via the vacuum system. In the embodiment, the thickness of the NCVM layer 35 is about 0.1 μm to 0.5 μm.

In the embodiment, the OCA layer 36 is coated on the EL layer 31, and the EL layer 31 is laminated to the NCVM layer 35 via the OCA layer 36 by the laminating device. In the embodiment, the refractive index of the NCVM layer 35 is about 1. The refractive index of the glass layer 32 is about 2. The refractive index of the first UV ink layer 33 is equal to or more than 1.7. The refractive index of the second UV ink layer 34 is equal to or more than 1.4. The refractive index of the OCA layer 14 is equal to or more than 1.4. Consequently, the refractive index of the first UV ink layer 33 is greater than the refractive index of the NCVM layer 35 and the second UV ink layer 34.

As shown in FIG. 3, the layers are the glass layer 32, the second UV ink layer 34, the first UV ink layer 33, the NCVM layer 35, the OCA layer 36 and the EL layer 31 from top to bottom. When the EL layer 31 is connected to the power source, the light passes through the OCA layer 36, the NCVM layer 35, the first UV ink layer 33, the second UV ink layer 34 and the glass layer 32, and then emits out from the top surface of the glass layer 32. The first pattern 3321 is formed on the first UV ink layer 33, and the second the pattern 3421 is formed on the second UV ink layer 34. Thus, when the lighting structure is viewed from the top as shown in FIG. 3, the overlapped patterns of the two UV ink layers can be viewed due to the light refraction.

In the embodiment, the refractive index of the first UV ink layer 33 is different from the refractive index of the NCVM layer 35. Consequently, even the NCVM layer 35 fills gaps of the first pattern 3321 of the first UV ink layer 33, the first pattern 3321 on the first UV ink layer 33 still can be seen clearly. Moreover, the refractive index of the first UV ink layer 33 is different from the refractive index of the second UV ink layer 34. Consequently, even the first UV ink layer 33 fills gaps of the second the pattern 3421 of the second UV ink layer 34, the pattern on the first UV ink layer 33 and the pattern on the second UV ink layer 34 still can be seen clearly.

In the embodiments, In contrast that the pattern formed on the glass layer, the patterns formed on the glass layer in embodiments are much finer. With two UV ink layers, the patterns formed at the two UV ink layers can be various and more beautiful.

Although the disclosure has been disclosed with reference to certain preferred embodiments thereof, the disclosure is not for limiting the scope. Persons with ordinary skill in the art may make various modifications and changes without departing from the scope of the disclosure. Therefore, the scope of the appended claims should not be limited to the description of the preferred embodiments described above.

What is claimed is:

1. A lighting structure with patterns, comprising:
an electro-luminescence (EL) layer;
a glass layer;
a first ultraviolet (UV) ink layer, wherein the first UV ink layer includes a first surface and a second surface, the first surface is laminated to the glass layer, the second surface includes a first pattern;
a non-conductive vacuum metallization (NCVM) layer, wherein the NCVM layer is formed on the second surface of the UV ink layer; and
an optically clear adhesive (OCA) layer, wherein the OCA layer is coated on the EL layer, and the EL layer is laminated to the NCVM layer via the OCA layer.

2. The lighting structure according to claim 1, wherein a refractive index of the first UV ink layer is equal to or more than 1.7.

3. The lighting structure according to claim 2, wherein a material of the first UV ink layer includes a sulfur-containing epoxy monomer and an acrylic monomer.

4. The lighting structure according to claim 3, wherein a material of the first UV ink layer includes polyoxyethylene.

5. The lighting structure according to claim 1, wherein a refractive index of the first UV ink layer is greater than that of the NCVM layer.

6. The lighting structure according to claim 1, wherein the lighting structure further includes a second UV ink layer, the second UV ink layer is formed between the glass layer and the first UV ink layer, and the second UV ink layer includes a second pattern.

7. The lighting structure according to claim 6, wherein a refractive index of the second UV ink layer is 1.4.

8. The lighting structure according to claim 1, wherein a refractive index of the OCA layer is greater than 1.4.

9. A lighting structure with patterns, comprising:

an electro-luminescence (EL) layer;

a glass layer, wherein a pattern is formed on a surface of the glass layer;

a non-conductive vacuum metallization (NCVM) layer, wherein the NCVM layer is formed on the surface of the glass layer with the pattern; and an optically clear adhesive (OCA) layer, wherein the OCA layer is coated on the EL layer, and the EL layer is laminated to the NCVM layer via the OCA layer.

10. The lighting structure according to claim 9, wherein a refractive index of the NCVM layer is less than that of the glass layer and the OCA layer.

* * * * *